US006029906A

United States Patent [19]

Binder et al.

[11] Patent Number: 6,029,906

[45] Date of Patent: Feb. 29, 2000

[54] ROTARY NOZZLE FOR A HIGH-PRESSURE CLEANING APPARATUS

[75] Inventors: Juergen Binder, Leutenbach; Robert Nathan, Backnang, both of Germany

[73] Assignee: Alfred Karcher GmbH & Co., Winnenden, Germany

[21] Appl. No.: 09/247,167

[22] Filed: Feb. 9, 1999

Related U.S. Application Data

[63] Continuation of application No. PCT/EP97/09312, Aug. 7, 1997.

[30] Foreign Application Priority Data

Aug. 10, 1996 [DE] Germany ..... 196 32 323

[51] Int. Cl.[7] ..... B05B 3/04

[52] U.S. Cl. ..... 239/237; 239/381

[58] Field of Search ..... 239/240, 227, 239/237, 263, 264, 470, 381, 463

[56] References Cited

U.S. PATENT DOCUMENTS

| | | | |
|---|---|---|---|
| 4,802,628 | 2/1989 | Dautel et al. | 239/240 X |
| 4,989,786 | 2/1991 | Kranzle et al. | 239/240 |
| 5,217,166 | 6/1993 | Schulze et al. | 239/227 |
| 5,332,155 | 7/1994 | Jager | 239/240 |
| 5,395,053 | 3/1995 | Frech | 239/227 |
| 5,551,635 | 9/1996 | Jager | 239/240 |

FOREIGN PATENT DOCUMENTS

| | | |
|---|---|---|
| 36 23 368 | 9/1987 | Germany . |
| 90 04 452 | 8/1990 | Germany . |
| 40 13 446 | 5/1991 | Germany . |

*Primary Examiner*—Kevin Weldon

*Attorney, Agent, or Firm*—Barry R. Lipsitz; Ralph F. Hoppin

[57] ABSTRACT

A rotary nozzle for a high-pressure cleaning apparatus has a housing into which a feed line for a cleaning fluid issues, an outlet provided in the housing for expelling the cleaning fluid, a nozzle body through which the cleaning fluid flows, and a bearing that surrounds the outlet. The nozzle body is disposed in the housing, and is supported at its convex end in the bearing. The bearing is formed directly in an inner wall of the housing as a conically-shaped depression to avoid the need for a separate bearing insert, thereby simplifying the manufacturing process. Additionally, the conical shape of the bearing cooperates with the convex shape of the nozzle body to provide optimal sealing with a reduced contact surface for a long service life. The bearing is disposed concentrically relatively to the outlet. The nozzle body is set by the flow of cleaning fluid through the housing in a revolving movement in which a longitudinal axis of the nozzle body revolves on a generated cone.

14 Claims, 2 Drawing Sheets

ROTARY NOZZLE FOR A HIGH-PRESSURE CLEANING APPARATUS

BACKGROUND OF THE INVENTION

This applications is a continuation of PCT/EP97/04312 filed Aug. 7, 1997.

The invention relates to a rotary nozzle for a high-pressure cleaning apparatus, with a housing into which a feed line for the cleaning fluid issues, with an outlet for the cleaning fluid and with a nozzle body through which the cleaning fluid flows, said nozzle body, which is disposed in the housing, being supported at a convex end in a pan-type bearing that surrounds the housing outlet and being set by the flow of cleaning fluid through the housing in a revolving movement in which the longitudinal axis of the nozzle body revolves on a generated cone, wherein the bearing which supports the nozzle body is formed by a depression which is provided in the inner wall of the housing and is disposed concentrically relatively to the outlet.

Rotary nozzles are known for example from DE 40 13 446 B1. Due to the revolving of the nozzle body on a generated cone, the jet of cleaning fluid delivered by it and released through the outlet out of the housing is run on a generated cone, so that it is possible with such a rotary nozzle to cover a greater area with a jet which itself remains compact and has only a very small cross-section.

With rotary nozzles of this kind the nozzle body is pressed into the depression with great force in axial direction; to enable these forces to be absorbed, an attempt is therefore made with known rotary nozzles to introduce special bearing surfaces into the housing, which are capable of coping with the load applied by the abutment of the rotary body. This leads to a relatively complex structure, since a special bearing body which supports the nozzle body has to be introduced into the housing.

There is known from DE 90 04 452 U1 a rotary nozzle with which the loading in the bearing area is to be prevented by complicated sealing measures being undertaken in the rotary nozzle, for example by the use of a rubber diaphragm. This leads to an extremely complicated structure in which there is nevertheless the risk of damage, namely if the complicated sealing measures are not operable to the full extent.

SUMMARY OF THE INVENTION

The object of the invention is to construct a rotary nozzle of the generic kind in such a way that the complexity of its manufacture is reduced.

This object is achieved according to the invention with a rotary nozzle of the kind described in the preamble by the depression being constructed conical in shape.

It has been found, surprisingly, that a conical configuration of the depression leads in co-operation with the convex shape of the end of the nozzle body that is supported in the bearing to an optimal sealing which is retained even when dirt particles and chemicals get into the seal area. The linear supporting of the convex-shaped end with the correspondingly reduced contact surface leads to a much reduced possibility of damage to these contact surfaces, and long service lives can therefore be achieved with such a construction, even when the cleaning fluid is contaminated, if the bearing is a direct part of the housing, i.e. it does not consist of a special bearing body of highly wear-resistant material. With such a construction, therefore, it is neither necessary to use a special bearing body of highly wear-resistant material, nor is there the need to additionally seal the bearing area in any way relative to the fluid to be transported.

It is beneficial if the aperture angle of the depression is between 110 and 150°, in particular between 120 and 140°, preferably 130°.

The convex end of the nozzle body can be spherical in shape, wherein it is beneficial if the radius is between 3 and 7 mm, preferably 5 mm.

In a particularly preferred embodiment it is provided that the housing consists of plastics material, in particular of polyamide, wherein it is advantageous if the polyamide contains a proportion of glass fibre, for example of the order of magnitude of 30%.

According to a preferred embodiment it is provided that the housing comprises a housing base into which the feed line leads, and a housing hood connectable with the latter in which the outlet with the depression is provided. It is possible in this way to separate the housing in a simple manner, the housing hood can be replaced, so that if wear becomes visible in the area of the bearing a new housing hood can simply be placed on the housing base. Housing base and housing hood can preferably be connectable to one another by screwing.

It can be provided in manner known per se that the nozzle body consists of a tubular body with a nozzle inserted into the latter, said nozzle forming the convex end of the nozzle body.

In a preferred embodiment it is however provided that the nozzle body comprises a tubular body whose one end forms the convex end of the nozzle body. In this case therefore the introduction of a separate nozzle is not necessary, but the nozzle body itself forms the revolving body with flow channel, the nozzle and the convex end for supporting in the depression.

In this case also it is advantageous if the nozzle body consists at least in the area of the convex end of plastics material, in particular of polyether ether ketone.

The material pairing glass-fibre-reinforced polyamide/polyether ether ketone is moreover particularly wear-resistant, so that long service lives are achieved with a pairing of such plastics, although no special bearing bodies are provided. All in all the manufacturing costs and the manufacturing complexity can be reduced considerably in this way, since it suffices to manufacture nozzle body and housing hood of plastics material by the conventional method of manufacture, after which these parts can be introduced into the rotary nozzle without further changes.

The following description of preferred embodiments of the invention serves for further explanation in conjunction with the drawings.

DETAILED DESCRIPTION OF THE INVENTION

Figure 1:
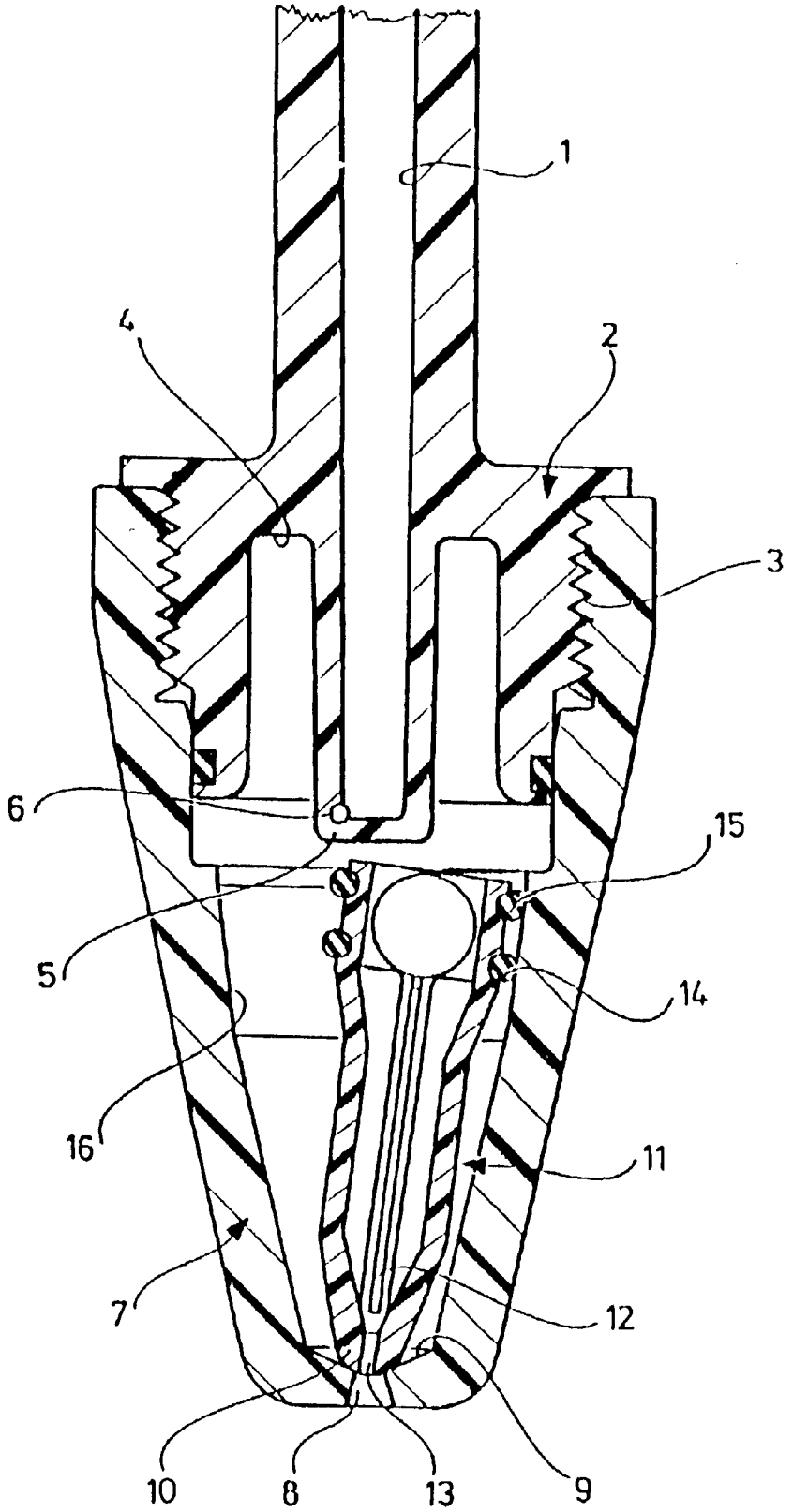
FIG. 1 shows a cross-sectional, lengthwise view of a rotary nozzle according to a first embodiment and FIG. 2 a view similar to FIG. 1 according to a second preferred embodiment.

The rotary nozzle shown in the drawing is attached to the end of a feed line 1 in order to deliver cleaning fluid, which is supplied via the feed line from a high-pressure cleaning apparatus, under high pressure in a compact jet which revolves along a generated cone.

The feed line 1 issues in a housing base 2 which has substantially the shape of a pot with a male thread 3. The issuing of the feed line 1 takes place centrally, wherein the feed line 1 passes through the bottom 4 of the pot-shaped housing base 2 and runs roughly up to the upper edge 5 of the pot-shaped housing base 2. The feed line 1 is sealed at the front end in this area, but an opening 6 leads out of the feed line 1, which is so oriented that the fluid leaving said opening 6 has a substantial component which lies in a plane lying at right angles on the feed line 1 and which runs in peripheral direction relative to the longitudinal axis of the feed line 1

There is screwed onto the male thread 3 of the housing base 2 a hood 7, which forms together with the housing base 2 a sealed housing. This hood 7 comprises on the side lying opposite the housing base 2 a conically extending outlet opening 8, immediately in front of which, in the direction of the inside of the housing, is a conical depression 9 which is disposed concentrically relative to the outlet opening 8 and has an aperture angle of about 130°.

This depression 9 forms a pan-type bearing for the convex end 10 of a substantially tubular nozzle body 11, which comprises a flow channel continuous in lengthwise direction. This flow channel 12 ends in a nozzle opening 13 which exits centrally from the convex end 10 and is aligned with the outlet opening 8.

The tubular nozzle body 11 bears on the outside at its end lying opposite the convex end 10 two O-rings 14, 15 running in peripheral direction, which are supported on the inner wall 16 of the hood 7.

In operation, cleaning fluid supplied through the opening 6 by the feed line 1 enters tangentially into the housing interior, so that the amount of fluid inside the housing which is formed by the hood 7 and the housing base 2 rotates about the longitudinal axis of the housing. At the same time this rotating fluid sets in motion the nozzle body 11, which under the effect of the centrifugal forces is placed against the inner wall 16 of the hood 7 by means of the O-rings 14 and 15, so that the longitudinal axis of the nozzle body 11 revolves on a cone whose tip is formed by the deepest point of the depression 9 and whose longitudinal axis coincides with the longitudinal axis of the housing. The fluid passes through the flow channel 12 of the nozzle body 11 and leaves the nozzle opening 13 in the direction of the longitudinal axis of the nozzle body 11, i.e. likewise revolving on a generated cone, which opens outwards to originate at the outlet opening 8.

The nozzle body 11 consists completely of plastics material, preferably of polyether ether ketone, and the housing also is preferably made of plastics material, for example of polyamide with a glass fibre content of 30%.

The particularly highly loaded bearing area between the convex end 10 and the depression 9 in the inner wall of the hood 7 shown astonishingly little wear in such a construction, so that high service lives can be achieved with such a rotary nozzle. The parts can however be manufactured in an extremely simple manner, since the hood 7 is formed as a single-piece moulding, and the same applies essentially also to the nozzle body 11. These parts can also be replaced in an extremely simple manner by unscrewing the hood 7 from the housing base 2 and replacing it with a new one. The nozzle body 11 can also be replaced in a simple manner on this occasion if the wear should exceed a particular level.

Figure 2:
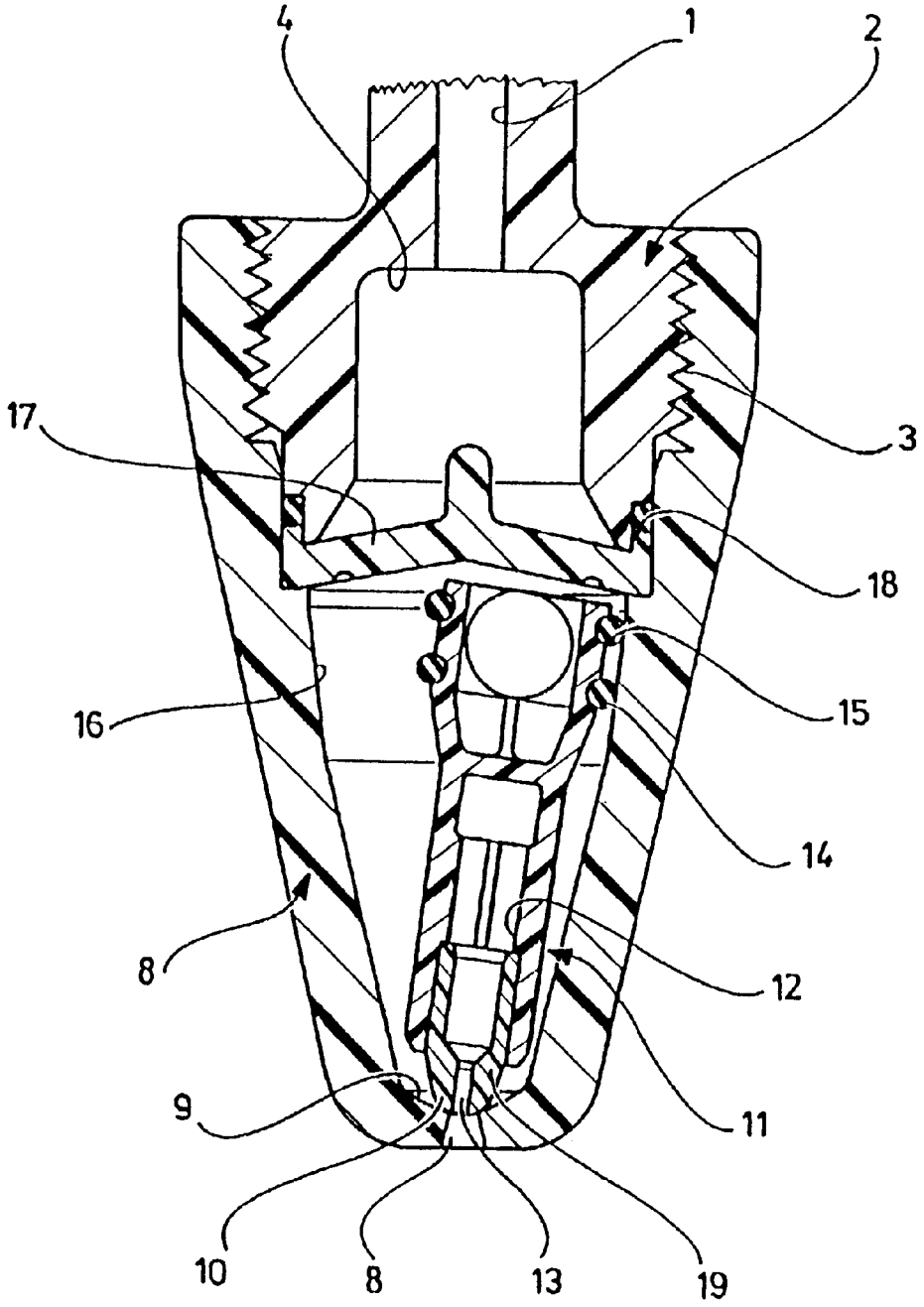

In the embodiment of FIG. 2 a similar layout is selected, and matching parts therefore bear the same reference symbols.

In contrast to the embodiment of FIG. 1, the housing base 2 is here formed open at the top, the feed line 1 issues directly into the inside of the housing base 2. The housing base 2 is sealed relative to the hood 7 by a cover 17 via a seal 18, in this case also the fluid is conveyed tangentially into the area enclosed by the hood 7 via an opening (not shown in this drawing).

The nozzle body 11 is in the embodiment shown in FIG. 2 of multi-part construction, there is namely introduced into the front end of the substantially tubular nozzle body 11 a special nozzle 19 whose end protruding out of the nozzle body 11 forms the convex end 10 of the nozzle body 11. This nozzle body 10 also consists of plastics material, as does the introduced nozzle 19, which can be manufactured for example of polyether ether ketone.

The rotary nozzle is otherwise of identical composition and also operates in the same manner as that of FIG. 1. The configurations of the two different housing bases can naturally also be exchanged, it is for example perfectly possible to use a nozzle body 11 with introduced nozzle 19 also in the embodiment of FIG. 1 and vice-versa.

What is claimed is:

1. A rotary nozzle for a high-pressure cleaning apparatus, comprising:

a housing into which a feed line for a cleaning fluid issues;

an outlet provided in said housing for expelling the cleaning fluid;

a nozzle body through which the cleaning fluid flows; and a bearing that surrounds the outlet; wherein:

said nozzle body is disposed in the housing and has a convex end;

said nozzle body is supported at its convex end in the bearing;

said nozzle body is set by the flow of cleaning fluid through the housing in a revolving movement in which a longitudinal axis of the nozzle body revolves on a generated cone; and the bearing is formed by a conically-shaped depression which is provided in an inner wall of the housing and is disposed concentrically relatively to the outlet.

2. The rotary nozzle of claim 1, wherein:

an aperture angle of the depression lies between approximately 110° and approximately 150°.

3. The rotary nozzle of claim 1, wherein:

the convex end is spherical shaped.

4. The rotary nozzle of claim 3, wherein;

a radius of the convex end lies between approximately 3 mm and approximately 7 mm.

5. The rotary nozzle of claim 1, wherein:

the housing comprises plastics material.

6. The rotary nozzle of claim 5, wherein:

the housing comprises polyamide.

7. The rotary nozzle according to claim 6, wherein:

the polyamide contains a proportion of glass fibre.

8. The rotary nozzle of claim 1, wherein:

the housing comprises a housing base into which the feed line issues, and a housing hood connectable to the housing base; and the outlet and the depression are provided in the housing hood.

9. The rotary nozzle of claim 8, wherein:

the housing base and housing hood are connectable to one another by screwing.

10. The rotary nozzle of claim 1, wherein:

the nozzle body comprises a tubular body, and a nozzle introduced into the tubular body; and said nozzle forms the convex end of the nozzle body.

11. The rotary nozzle of claim 1, wherein:

the nozzle body comprises a tubular body; and one end of the tubular body forms the convex end of the nozzle body.

12. The rotary nozzle of claim 1, wherein:

the nozzle body comprises plastics material, at least in an area of the convex end.

13. The rotary nozzle of claim 12, wherein:

the nozzle body comprises polyether ether ketone, at least in an area of the convex end.

14. The rotary nozzle of claim 1, wherein:

an aperture angle of the depression lies between approximately 120° and approximately 140°.

* * * * *

UNITED STATES PATENT AND TRADEMARK OFFICE

CERTIFICATE OF CORRECTION

PATENT NO. : 6,029,906
DATED : February 29, 2000
INVENTOR(S) : Binder et al.

It is certified that error appears in the above-identified patent and that said Letters Patent is hereby corrected as shown below:

On the Title page, left column, [63]

Continuation of application No. PCT/EP97/09312, Aug. 7, 1997 is changed to:

-- [63] Continuation of application no. PCT/EP97/04312 Aug. 7, 1997. --.

Signed and Sealed this

Sixth Day of February, 2001

*Attest:*

*Attesting Officer*

Q. TODD DICKINSON

*Director of Patents and Trademarks*